US007886904B1

(12) United States Patent
Evans

(10) Patent No.: US 7,886,904 B1
(45) Date of Patent: Feb. 15, 2011

(54) LOOSEFILL PACKAGE FOR BLOWING WOOL MACHINE

(75) Inventor: Michael E. Evans, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/512,163

(22) Filed: Jul. 30, 2009

(51) Int. Cl.
*B65D 71/00* (2006.01)

(52) U.S. Cl. ..... 206/321; 206/459.5; 206/83.5

(58) Field of Classification Search ..... 206/388, 206/321, 459.5, 83.5
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |
| 2,311,773 | A | 2/1943 | Patterson |
| 2,355,358 | A | 8/1944 | Anderson |
| 2,404,678 | A | 7/1946 | Erb |
| 2,437,831 | A | 3/1948 | Moore |
| 2,532,318 | A | 12/1950 | Mackey et al. |
| 2,532,351 | A | 12/1950 | Wedebrock |
| 2,550,354 | A | 4/1951 | Jacobsen |
| 2,618,817 | A | 11/1952 | Slayter |
| 2,721,767 | A | 10/1955 | Kropp |
| 2,754,995 | A | 7/1956 | Switzer |
| 2,794,454 | A | 6/1957 | Moulthrop |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner*—Jacob K Ackun, Jr.
(74) *Attorney, Agent, or Firm*—MacMillan, Sobanski & Todd, LLC

(57) ABSTRACT

Packages of compressed blowing wool are provided. The packages include a body of compressed blowing wool. The compression of the blowing wool is in a radially inward direction with respect to an axis extending from one end of the body of compressed blowing wool to another end of the body of compressed blowing wool. A bag encapsulates the body of compressed blowing wool. The bag has a plurality of bag sections and opposing ends. The bag sections have contrasting visual characteristics configured to focus the attention of a user toward one of the bag. One of the bag sections includes indicia configured to assist in opening one end of the bag.

20 Claims, 8 Drawing Sheets

U.S. PATENT DOCUMENTS 2,869,793 A 1/1959 Montgomergy
2,938,651 A 5/1960 Specht et al.
2,964,896 A 12/1960 Finocchiaro
2,984,872 A 5/1961 France
2,989,252 A 6/1961 Babb
3,051,398 A 8/1962 Babb
3,076,659 A 2/1963 Kremer
3,201,007 A 8/1965 Transeau
3,231,105 A 1/1966 Easley
3,255,869 A * 6/1966 Keller ..... 206/424
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffmann, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,129,338 A 12/1978 Mudgett
4,134,508 A 1/1979 Burdett, Jr.
4,155,486 A 5/1979 Brown
4,179,043 A 12/1979 Fischer
4,180,188 A 12/1979 Anouma et al.
4,236,654 A 12/1980 Mello
4,268,205 A 5/1981 Vacca et al.
4,273,296 A 6/1981 Hoshall
4,337,902 A 7/1982 Markham
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,516,499 A 10/1992 Miklich
5,166,236 A 11/1992 Alexander et al.
5,289,982 A 3/1994 Andersen
5,323,819 A 6/1994 Shade
5,368,311 A 11/1994 Heyl
5,380,094 A 1/1995 Schmidt et al.
5,405,231 A 4/1995 Kronberg
5,462,238 A 10/1995 Smith et al.
5,472,305 A 12/1995 Ikeda et al.
5,511,730 A 4/1996 Miller et al.
5,601,239 A 2/1997 Smith et al.
5,303,672 A 4/1997 Morris
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Khon et al.
5,829,649 A 11/1998 Horton
5,860,232 A 1/1999 Nathenson et al.
5,860,606 A 1/1999 Tiedeman et al.
5,862,650 A * 1/1999 Adams et al. ..... 53/473
5,927,558 A 7/1999 Bruce
5,934,809 A 8/1999 Marbler
5,987,833 A 11/1999 Heffelfinger et al.
5,997,220 A 12/1999 Wormser
6,036,060 A 3/2000 Munsch et al.
6,070,814 A 6/2000 Deitesfeld
6,074,795 A 6/2000 Watamabe et al.
6,109,488 A 8/2000 Horton
6,161,784 A 12/2000 Horton
6,209,724 B1 4/2001 Miller
6,257,410 B1 * 7/2001 Ulmann et al. ..... 206/389
6,266,843 B1 7/2001 Donan et al.
6,296,424 B1 10/2001 Ecket et al.
6,312,207 B1 11/2001 Rautiainen
6,503,026 B1 1/2003 Mitchell
6,510,945 B1 1/2003 Allwein et al.
6,648,022 B2 11/2003 Pentz et al.
6,698,458 B1 3/2004 Sollars
6,770,339 B2 * 8/2004 Teague et al. ..... 428/35.2
6,779,691 B2 8/2004 Cheng
6,783,154 B2 8/2004 Persson et al.
6,796,748 B1 9/2004 Sperber
6,826,991 B1 12/2004 Rasmussen
7,165,675 B2 * 1/2007 Anderson et al. ..... 206/459.1
7,198,154 B2 * 4/2007 Tippey ..... 206/494
7,354,466 B2 4/2008 Dunning et al.
7,448,494 B2 * 11/2008 LaSalle ..... 206/321
2001/0036411 A1 11/2001 Walker
2003/0075629 A1 4/2003 Lucas
2003/0192589 A1 10/2003 Jennings
2003/0215165 A1 11/2003 Hogan et al.
2003/0234264 A1 12/2003 Landau
2004/0124262 A1 7/2004 Bowman et al.
2005/0006508 A1 1/2005 Roberts
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 10/2006 Evans et al.
2007/0138211 A1 6/2007 O'Leary et al.
2008/0087751 A1 4/2008 Johnson et al.
2008/0115460 A1 * 5/2008 Ruid et al. ..... 53/428

FOREIGN PATENT DOCUMENTS

DE 3240126 5/1984
EP 0265751 4/1988
FR 2350450 3/1979
GB 1418882 12/1975
GB 1574027 9/1980
GB 2099776 12/1982
GB 2124194 2/1984
GB 2156303 10/1985
GB 2212471 7/1989
GB 2276147 9/1994
JP 407088985 4/1995
NL 8204888 7/1984

OTHER PUBLICATIONS

Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.

Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. by UNISUL, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm-Apr. 14, 2009, OC002923-OC002925, 3 pages.
The Quantum Insulation Blower, Intec, Frederick, CO, http://www.inteccorp.com/Quantum.htm-Apr. 14, 2009 OC002930-OC002931, 2 pages.
The Wasp Insulation Blower, Intec, Frederick, CO, http://www.intec-corp.com/Wasp.com-May 18,2005, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV 3/04, CT0000008-CT0000055, 50 pages.
Insulation Blowers—Accul 9118, Insulation Machine Corp., Springfield, MA, Copyright 2006, http://accuone.com/accul_9118.html-Apr. 4, 2009, CT0000056-CT0000057, 2 pages.
AccuOne 9400, AccuOne Industries, Inc., Copyright 1998, http://www.accu1.com/A9400.html-Jul. 13, 2004, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp?PartNo=450A-7/13/04, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html-Apr. 6, 2009, CT0000449-CT0000451, 3 pages.
X-Floc Zellofant M95, X-Floc GmbH, Renningen, Germany, Feb. 8, 2009, http://www.x-floc.com/en/machines/zellofant-m95.html-Apr. 13, 2009, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.html-Apr. 4, 2009, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog. asp-Jan. 4, 2008, CT0000606-CT0000608, 3 pages.
Cocoon-Attic Insulation Blowing Machine, Exhibit II, 2 pages.
U.S. Appl. No. 10/899,909—Advisory Action, May 26, 2009.
U.S. Appl. No. 10/899,909—Response to Final, May 12, 2009.
U.S. Appl. No. 10/899,909—Final Rejection, Mar. 20, 2009.
U.S. Appl. No. 10/899,909—Rejection, Sep. 20, 2007.
U.S. Appl. No. 10/899,909—Rejection, Apr. 4, 2008.
U.S. Appl. No. 10/899,909—Response, Aug. 27, 2007.
U.S. Appl. No. 10/899,909—Response, Dec. 20, 2007.
U.S. Appl. No. 10/899,909—Response, May 16, 2008.
U.S. Appl. No. 10/899,909—Response, Jan. 7, 2009.
U.S. Appl. No. 10/899,909—Restriction, Jul. 31, 2007.
U.S. Appl. No. 11/024,093—3 month office action, Mar. 2, 2007.
U.S. Appl. No. 11/024,093—3 month office action, Jul. 12, 2007
U.S. Appl. No. 11/024,093—3 month office action, Mar. 5, 2009.
U.S. Appl. No. 11/024,093—Advisory Action, Jan. 11, 2008.
U.S. Appl. No. 11/024,093—Final 3 month, Oct. 24, 2007.
U.S. Appl. No. 11/024,093—RCE, Jan. 22, 2008.
U.S. Appl. No. 11/024,093—Response, Jan. 24, 2007.
U.S. Appl. No. 11/024,093—Response, Jun. 4, 2007.
U.S. Appl. No. 11/024,093—Response, Oct. 12, 2007.
U.S. Appl. No. 11/024,093—Response, Dec. 20, 2007.
U.S. Appl. No. 11/024,093—Response, May 28, 2009.
U.S. Appl. No. 11/024,093—Restriction, Nov. 24, 2006.
U.S. Appl. No. 11/303,612—3 Month, Oct. 15, 2009.
U.S. Appl. No. 11/303,612—Final 3 Month, Apr. 30, 2009.
U.S. Appl. No. 11/452,554—3 Month Office Action, Apr. 8, 2008.
U.S. Appl. No. 11/452,554—Advisory Action, Feb. 6, 2009.
U.S. Appl. No. 11/452,554—Final 3 Month, Oct. 15, 2008.
U.S. Appl. No. 11/452,554—Final 3 Month, May 5, 2009.
U.S. Appl. No. 11/452,554—RCE, Mar. 11, 2009.
U.S. Appl. No. 11/452,554—Response, Jun. 4, 2008.
U.S. Appl. No. 11/452,554—Response After Final, Jan. 14, 2009.
U.S. Appl. No. 11/581,660—3 month office, May 28, 2009.
U.S. Appl. No. 11/581,661—3 Month, Apr. 3, 2008.
U.S. Appl. No. 11/581,661—3 Month, May 5, 2009.
U.S. Appl. No. 11/581,661—Advisory Action, Jan. 27, 2009.
U.S. Appl. No. 11/581,661—Final 3 Month, Dec. 3, 2008.
APSCO—Pneumatic Conveying: Dilute Phase Systems, Dense Phase Systems . . . .
Choosing a pneumatic conveying system . . .; Powder Bulk Engineering; Steve Grant.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303,612—Response, Jan. 14, 2009.
U.S. Appl. No. 11/581,661—Response, Jul. 17, 2008.
U.S. Appl. No. 11/303,612—Response AF, Jun. 29, 2009.
U.S. Appl. No. 11/581,661—Response AF, Jan. 9, 2009.
U.S. Appl. No. 11/581,661—Response; RCE, Feb. 25, 2009.

* cited by examiner

LOOSEFILL PACKAGE FOR BLOWING WOOL MACHINE

TECHNICAL FIELD

This invention relates to loosefill insulation for insulating buildings. More particularly this invention relates to distributing packaged loosefill insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a chute or hopper for containing and feeding the blowing wool after the package is opened and the blowing wool is allowed to expand.

It would be advantageous if the blowing wool packages could be improved to make them easier to use.

SUMMARY OF THE INVENTION

In accordance with embodiments of this invention there are provided packages of compressed blowing wool. The packages include a body of compressed blowing wool. The compression of the blowing wool is in a radially inward direction with respect to an axis extending from one end of the body of compressed blowing wool to another end of the body of compressed blowing wool. A bag encapsulates the body of compressed blowing wool. The bag has a plurality of bag sections and opposing ends. The bag sections have contrasting visual characteristics configured to focus the attention of a user toward one end of the bag. One of the bag sections includes indicia configured to assist in opening one end of the bag.

In accordance with embodiments of this invention there are also provided methods of distributing blowing wool from a package of compressed blowing wool. The methods include the steps of providing a package of compressed blowing wool, the package having a body of compressed blowing wool, the compression of the body of blowing wool being in a radially inward direction with respect to an axis extending from one end of the body of compressed blowing wool to another end of the body of compressed blowing wool and a bag encapsulating the body of compressed blowing wool, the bag having a plurality of bag sections and opposing ends, the bag sections having contrasting visual characteristics configured to focus the attention of a user toward one end of the bag, wherein one of the bag sections includes indicia configured to assist in opening one end of the bag, opening one end of the bag thereby forming a package with an open end and a closed end, the bag being opened such that the compression of the body of blowing wool is retained in a radially inward direction after one end of the bag is opened, gripping the closed end of the package, feeding the open end of the package into a machine for shredding and picking apart the blowing wool thereby emptying the bag and withdrawing the empty bag from the machine.

Various objects and advantages of this invention will become apparent to those skilled in the art from the following detailed description of the preferred embodiment, when read in light of the accompanying drawings.

DETAILED DESCRIPTION OF THE INVENTION

Figure 1:
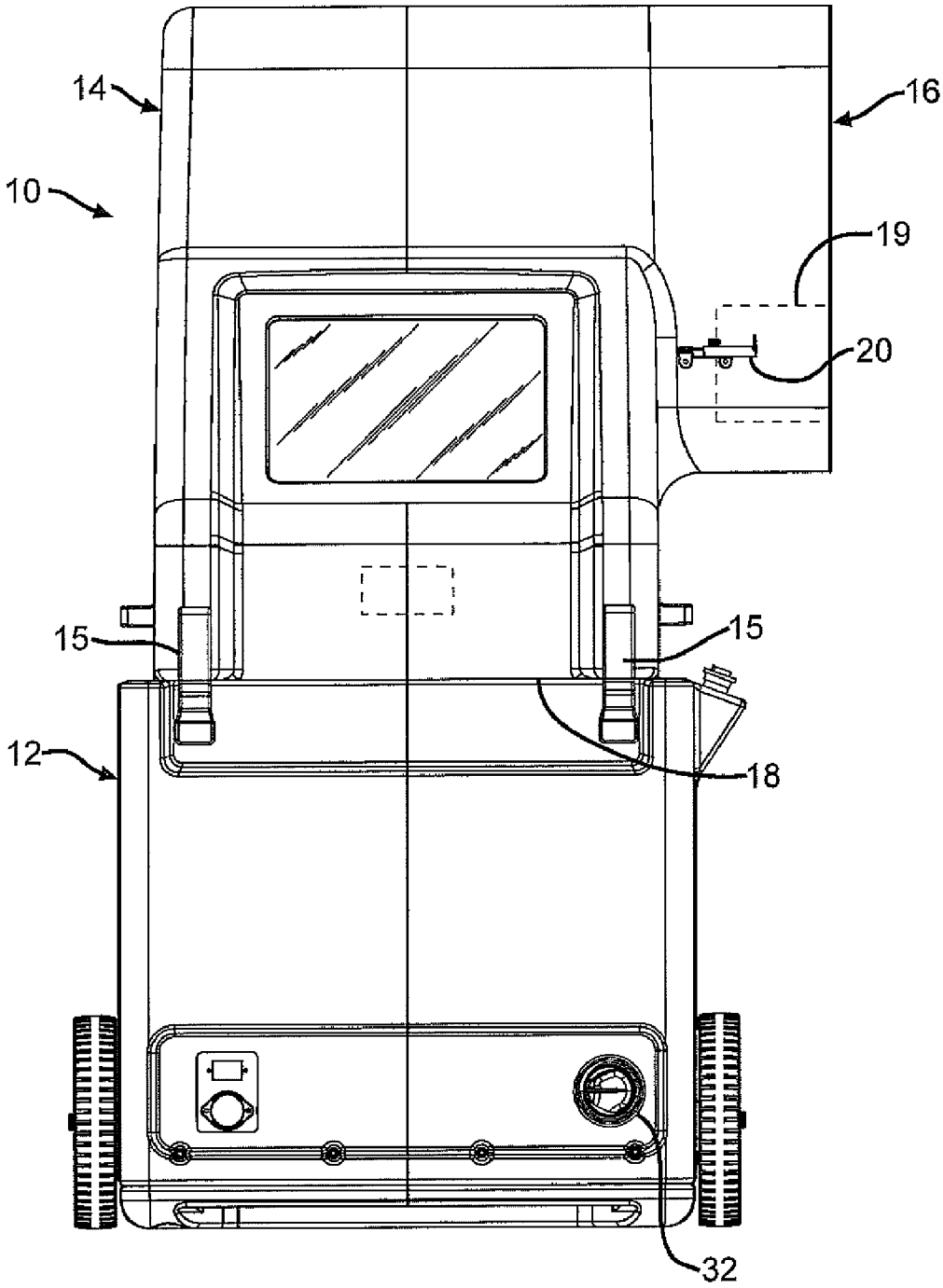
FIG. 1 is a front view in elevation of an insulation blowing wool machine.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, packages of compressed blowing wool encapsulated by bags are provided. The term "bag" as used herein, is defined to mean a container or receptacle having the capacity of closing an opening to container or receptacle. The term "blowing wool", as used herein, is defined to any insulation materials configured for distribution in an airstream. The term "compressed", as used herein, is defined to mean condensing into a smaller space. The term "opaque" as used herein, is defined to mean substantially impenetrable to light. The term "transparent" as used herein, is defined to mean having the ability to transmit light through its substance. The term "translucent" as used herein, is defined to mean having the ability to permit light to pass through but diffusing the light so that objects on the opposite side are not clearly visible.

The description and figures disclose packages of compressed blowing wool having bags with sections of contrasting visual characteristics. Generally, the contrasting visual characteristics assist the operator of a blowing wool machine in opening an end of the bags of compressed blowing wool and loading the compressed blowing wool from the packages of compressed blowing wool into the blowing wool machine. The contrasting visual characteristics include color and the opacity or transparency of the sections of the bag.

One example of a blowing wool machine for distributing compressed blowing wool, illustrated generally at 10 and shown in FIGS. 1-3, will be briefly described below. However, it should be appreciated that the packages of compressed blowing wool can be used in other blowing wool machines.

Figure 2:
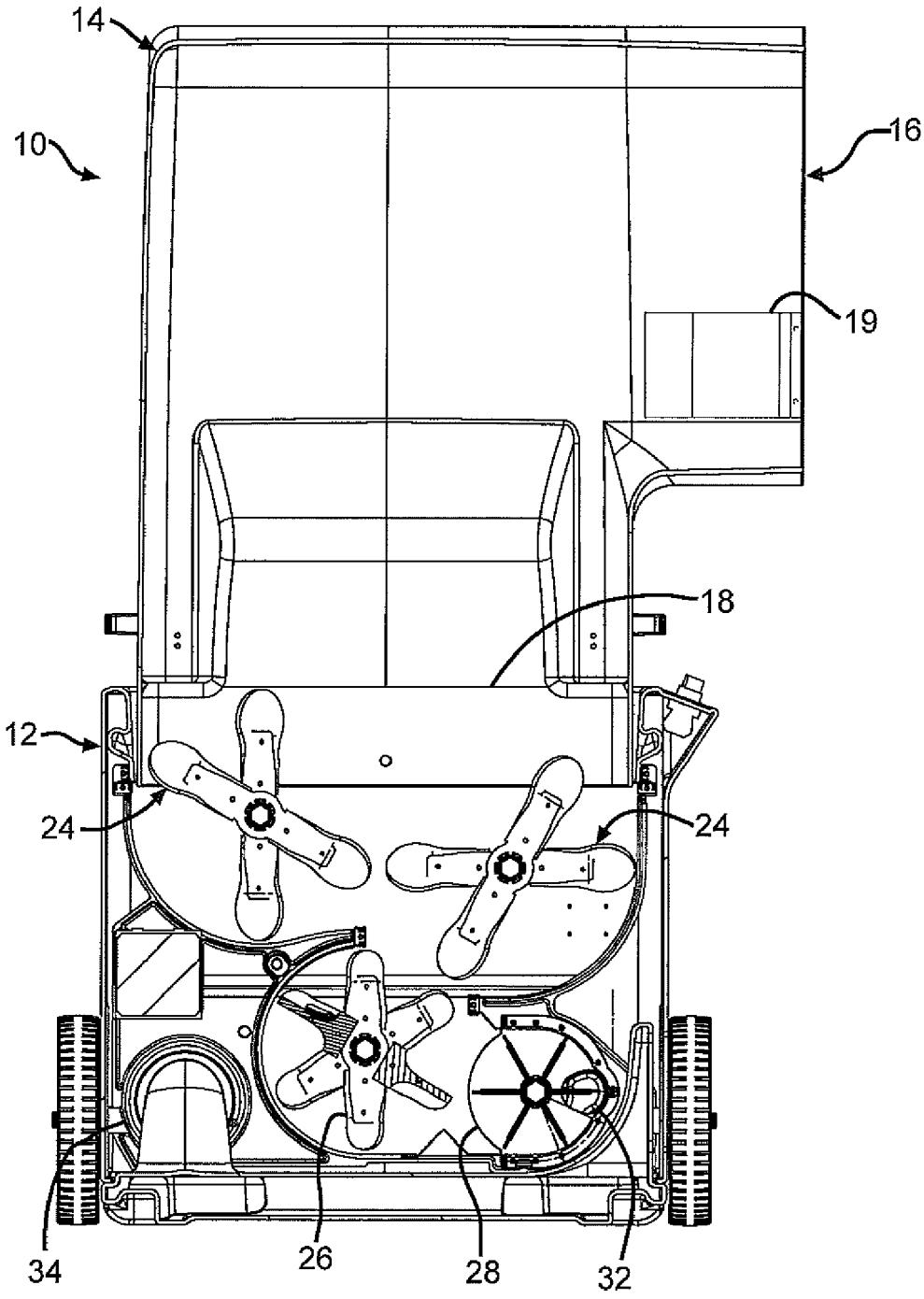
FIG. 2 is a front view in elevation, partially in cross-section, of the insulation blowing wool machine of FIG. 1.
Figure 3:
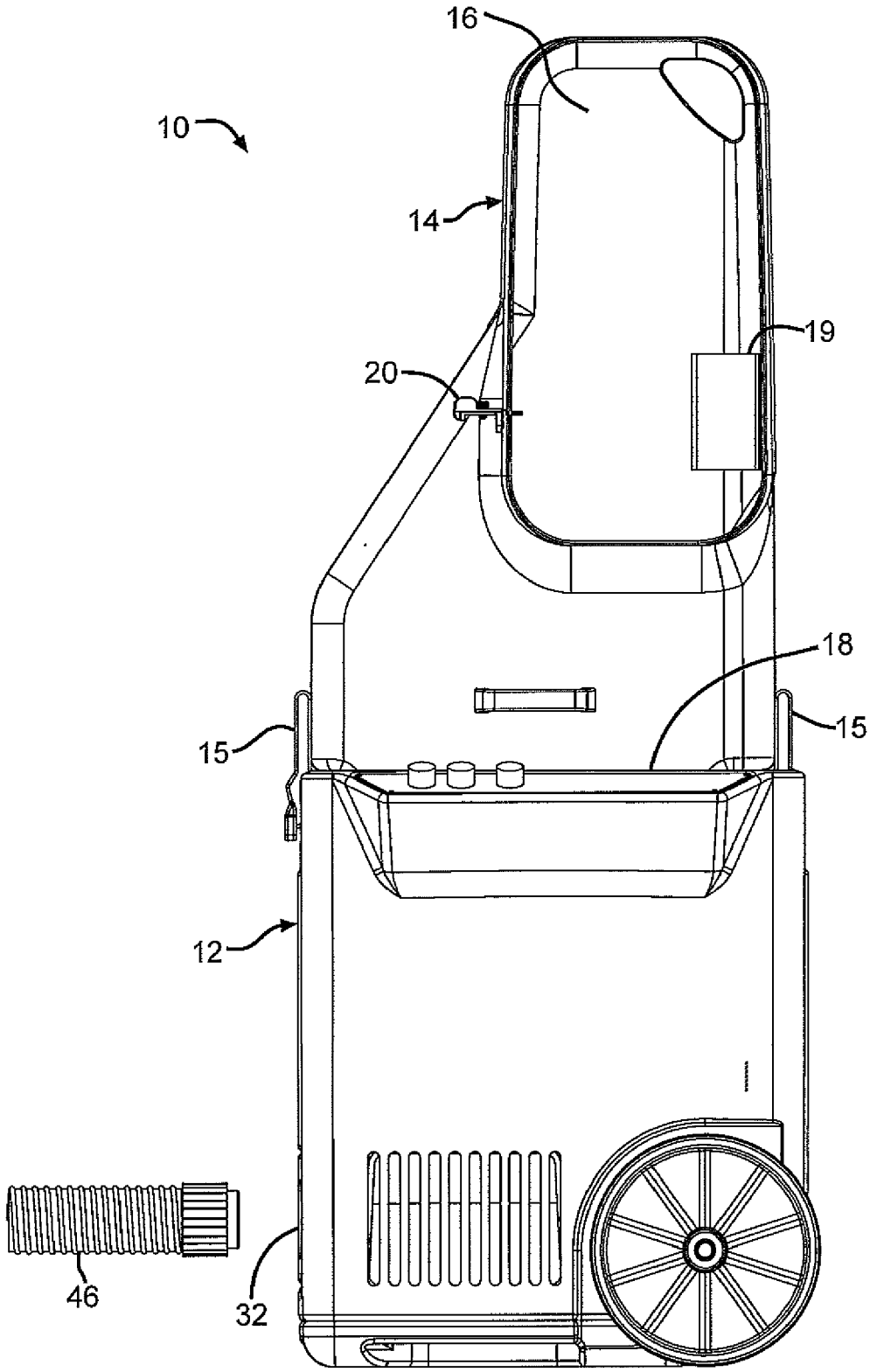
FIG. 3 is a side view in elevation of the insulation blowing wool machine of FIG. 1.

Referring now to FIGS. 1-3, the blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to a plurality of low speed shredders 24 as shown in FIG. 2.

As further shown in FIGS. 1-3, the chute 14 can include an optional guide assembly 19 positioned at the inlet end 16 of the chute 14. The guide assembly 19 is configured to urge a package of compressed blowing wool against a cutting mechanism 20 as the package moves into the chute 14.

As shown in FIG. 2, the low speed shredders 24 are mounted in the lower unit 12 at the outlet end 18 of the chute 14. The low speed shredders 24 are configured to shred and pick apart the blowing wool as the blowing wool is discharged from the outlet end 18 of the chute 14 into the lower unit 12. Although the disclosed blowing wool machine 10 is shown with the plurality of low speed shredders 24, any type of separator, such as a clump breaker, beater bar or any other mechanism that shreds and picks apart the blowing wool can be used.

As further shown in FIG. 2, an agitator 26 is provided for final shredding of the blowing wool and for preparing the blowing wool for distribution into an airstream. A discharge mechanism 28 is positioned downstream from the agitator 26 to distribute the shredded blowing wool into the airstream. The discharge mechanism 28 can be a rotary valve, or other desired devices or mechanisms including staging hoppers, metering devices, rotary feeders, sufficient to distribute the shredded blowing wool into an airstream. The shredded blowing wool is driven through the discharge mechanism 28 and through a machine outlet 32 by an airstream provided by a blower (not shown) mounted in the lower unit 12.

The shredders 24, agitator 26 and the discharge mechanism 28 are mounted for rotation. They can be driven by any suitable means, such as by an electric motor 34, or any other means sufficient to drive rotary equipment. Alternatively, each of the shredders 24, agitator 26, and discharge mechanism 28 can be provided with its own electric motor.

In general, the chute 14 guides the blowing wool to the low speed shredders 24 which shred and pick apart the blowing wool. The shredded blowing wool drops from the low speed shredders 24 into the agitator 26. The agitator 26 prepares the blowing wool for distribution into an airstream by further shredding the blowing wool into finely shredded blowing wool. The finely shredded blowing wool exits the agitator 26 and enters the discharge mechanism 28 for distribution into the airstream caused by the blower. The airstream, with the finely shredded blowing wool, exits the machine 10 at the machine outlet 32 and flows through a distribution hose 46, as shown in FIG. 3, toward the insulation cavity, not shown.

Figure 4:
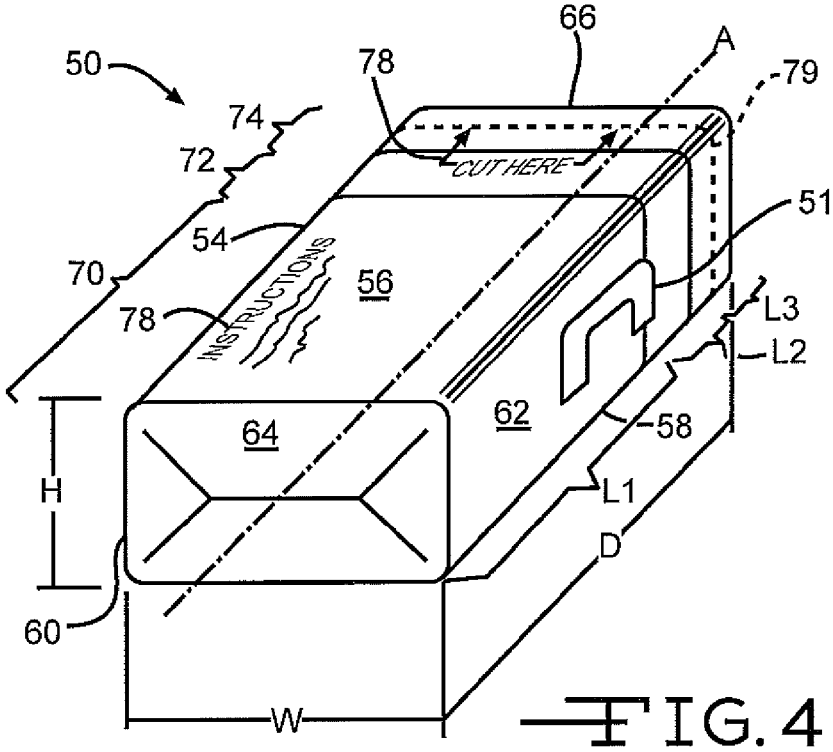
FIG. 4 is a perspective view of a first embodiment of a package of compressed blowing wool.
Figure 5:
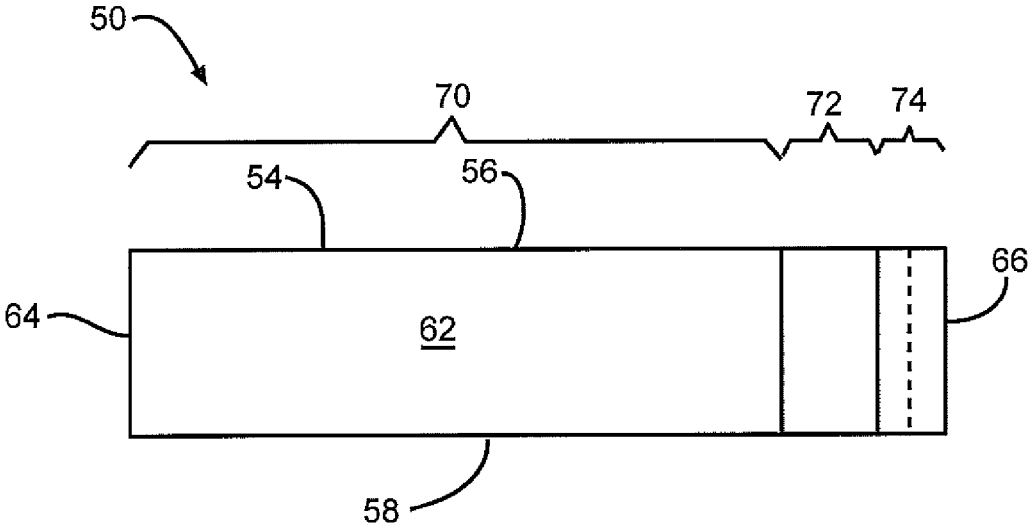
FIG. 5 is a side view in elevation of the package of compressed blowing wool of FIG. 4.

Referring now to FIGS. 3-5, the chute 14 has a substantially rectangular cross-sectional shape that approximates the substantially rectangular cross-sectional shape of a package 50 of a body of compressed blowing wool. As shown in FIG. 4, the package 50 has a width W, a depth D and a height H. In the illustrated embodiment, width W is approximately 19 inches, the depth D is approximately 19 inches and the height H is approximately 9 inches. However, the width W, depth D height H can be other desired dimensions. Referring again to FIG. 3, the chute 14 has a substantially rectangular cross-section shape of about 9 inches by 20 inches. The substantially rectangular cross-sectional shape of the chute 14 allows the package 50 to be easily received and fed through the chute 14.

Referring again to FIG. 4, the package 50 of compressed blowing wool includes a bag 54 that is configured to encapsulate the body of compressed blowing wool. In the illustrated embodiment, the bag 54 is made of a polymeric material, such as polyethylene, although any type of material suitable for maintaining the blowing wool in the desired compression can be used. The bag 54 is configured to provide a substantially waterproof barrier against water, dirt and other deleterious effects. By using a polymeric material for the bag 54, the compressed blowing wool will be substantially protected from the elements during transportation and storage of the package 50.

While the bag 54 illustrated in FIG. 4 is a continuous structure configured for maintaining the body of compressed blowing wool in the desired compression, it should be appreciated that the bag 54 can be embodied as other desired structures, including non-continuous structures such as for example netting.

The body of compressed blowing wool in the package 50 can be any loosefill insulation, such as a multiplicity of discrete, individual tuffs, cubes, flakes, or nodules. The blowing wool can be made of glass fibers or other mineral fibers, and can also be organic fibers or cellulose fibers. The blowing wool can have a binder material applied to it, or it can be binderless. The body of compressed blowing wool in the package 50 is compressed to a compression ratio of at least 10:1, which means that the unconstrained blowing wool, after the bag 54 is opened, has a volume of 10 times that of the compressed blowing wool in the bag 54. Other compression ratios higher or lower than 10:1 can be used. The body of compressed blowing wool is compressed radially inwardly with respect to an axis A extending from one end of the body of compressed blowing wool to the opposing end of the body of compressed blowing wool.

Referring again to FIG. 4, the bag 54 has a top 56, a bottom 58, opposing first side 60 and second side 62, opposing first end 64 and second end 66, a first section 70, a second section 72 and a third section 74. The first section 70 extends circumferentially around the bag 54 along longitudinal axis A from the first end 64 to the second section 72. The second section 72 extends circumferentially around the bag 54 along longitudinal axis A from the first section 70 to the third section 74 and the third section 74 extends circumferentially around the bag 54 along longitudinal axis A from the second section 72 to the second end 66.

Optionally, the package 50 can include a handle 51 configured for lifting and transporting the package 50. The handle 51 can have any desired structure and can be positioned on the package 50 in a desired location.

The first section 70 has a length L1, the second section 72 has a length L2 and the third section 74 has a length L3. In the illustrated embodiment, the lengths L1, L2 and L3 are approximately 13 inches, 6 inches and 2 inches, respectively. In other embodiments, the lengths L1, L2 and L3 can be other desired sizes.

The first, second and third sections, 70, 72 and 74, of the bag 54 can be configured with different visual characteristics. For example, some sections of the bag 54 can be transparent, some sections of the bag 54 can be opaque and some sections of the bag 54 can be translucent. As another example, the sections of the bag 54 can have different background coloring. In the illustrated embodiment, the first section 70 of the bag 54 is opaque and the second and third sections, 72 and 74, of the bag 54 are transparent. In other embodiments, the first, second and third sections, 70, 72 and 74 can be alternately transparent, opaque or translucent. As will be described in more detail below, the differing visual characteristics of the first and second sections, 70 and 72, are configured to draw the attention of the machine user to the second end 66 of the bag 54.

Referring again to the embodiment shown in FIGS. 4 and 5, the first section 70 of the bag 54 has a substantially white background color, the second section 72 of the bag 54 lacks a background color and the third section 74 of the bag 54 has a substantially red background color. The substantially white background of the first section 70 is configured to provide a contrasting color from the second and third sections, 72 and 74, and further configured to provide a contrasting background color for indicia, as will be explained in more detail below. While the first section 70 is illustrated as having a substantially white background, it should be appreciated that the first section 70 can have other background colors sufficient to provide a contrasting color from the second and third sections, 72 and 74, and further sufficient to provide a contrasting background color for indicia.

The second section 72 of the bag 54 is transparent and lacks a background color. The transparency and lack of color of the second section 72 is configured to provide a contrast from the first section 70 and the third section 74. While the illustrated embodiment of the second section 72 is transparent and lacks color, it should be appreciated that the second section 72 can have opacity and can have a background color sufficient for the second section 72 to provide a contrast from the first section 70 and the third section 74.

The third section 74 of the bag 54 is transparent and has a substantially red background color. The transparency and substantially red background color of the third section 74 is configured to provide a contrast from the first and second sections, 70 and 72. While the illustrated embodiment of the third section 74 is transparent and has a substantially red background color, it should be appreciated that the third section 74 can have opacity and can be other colors sufficient for the third section 74 to provide a contrast from the first section 70 and the second section 72.

While the varying visual characteristics of the first, second and third sections, 70, 72 and 74 are illustrated and described above as extending circumferentially around the bag 54, it should be appreciated that the varying visual characteristics of the first, second and third sections, 70, 72 and 74 can circumferentially extend round only a desired portion around the bag 54.

Referring again to FIGS. 4 and 5, the third section 74 includes a suggested cut line 79. The suggested cut line 79 extends circumferentially around the third section 74 of the bag 54 and is configured as the location in which a machine user opens the bag 54. In the illustrated embodiment, the suggested cut line 79 is indicia having a series of bold black-colored dashes, however the suggested cut line 79 can be a series of other symbols. The suggested cut line 79 can be disposed on the bag 54 by various methods including printing on the bag 54 or by stickers disposed on the bag 54. In other embodiments, the suggested cut line 79 can be disposed on the bag 54 by other desired methods. The suggested cut line 79 can be positioned within the third section 74 at any desired distance from the end 66 of the package 50.

Optionally, the suggested cut line 79 can include a plurality of perforations (not shown) configured to assist the machine user in cutting the bag 54 at the suggested cut line 79. The perforations can have any desired configuration and can be formed in any desired manner. In still other embodiments, the suggested cut line 79 can be provided with a tear-away mechanism (not shown), such as for example a ripcord (not shown). Other desired tear-away mechanisms can also be used.

As discussed above, the first, second and third sections, 70, 72 and 74 have varying visual characteristics. In the illustrated embodiment, the first section 70 is opaque and has a substantially white background color. The second section 72 is transparent and lacks a background color. The third section 74 is transparent and has a substantially red background color. The visual characteristics of the third section 74, having the substantially red transparent background, is configured to draw the attention of the machine user away from the first and second sections, 70 and 72, to the suggested cut line 79 positioned in the third section 74.

Referring again to the embodiment shown in FIGS. 4 and 5, the top 56, sides 60 and 62, bottom 58 and ends 64 and 66, can include a plurality of indicia 78 disposed on the bag 54. The indicia 78 can include any desired symbol or message. As one example, the indicia 78 positioned in the third section 74 can include instructions to the machine user for cutting the package 50 along the suggested cut line 79. In another embodiment, the indicia 78 can include instructions informing the machine user on feeding package 50 into the machine 10. In other embodiments, the indicia 78 can include instructions to the machine user for disposal of the bag 54 after the body of blowing wool has been fed into the chute 14. In still other embodiments, the indicia 78 can include safety messages, warnings to the machine user, company information such as logos, addresses, or other general symbols. The indicia 78 can be disposed on the bag 54 in a manner similar to that for the suggested cut line 79.

In operation, packages 50 are provided to the machine user. The packages 50 include the first, second and third sections, 70, 72 and 74 having varying visual characteristics and the suggested cut line 79 positioned at the second end in the third section 74. The attention of the machine user is focused from the first and second sections, 70 and 72, to the third section 74 having the suggested cut line 79. The machine user cuts the bag 54 along the suggested cut line 79. In some embodiments, the user completely removes the second end 66 of the bag 54 and exposes the end of the body of compressed blowing wool by cutting the suggested cut line 79 on the bag top 56, bottom 58 and sides 60 and 62. In other embodiments, the user only cuts a portion of the suggested cut line 79, sufficient to fold back the second end 66 of the bag 54 and expose the end of the body of compressed blowing wool. Cutting the bag 54 along the suggested cut line 79 forms a cut bag having one open end and one uncut closed end. The machine user grips the uncut closed end of the bag and feeds the open end of the bag 54 into the chute 14 of the blowing wool machine 10. The machine user continues gripping the uncut closed end of the bag 54 as the blowing wool expands into the chute 14. After the blowing wool has been completely fed into the chute 14 thereby emptying the bag 54, the machine user withdraws the emptied bag from the machine 10.

Figure 6:
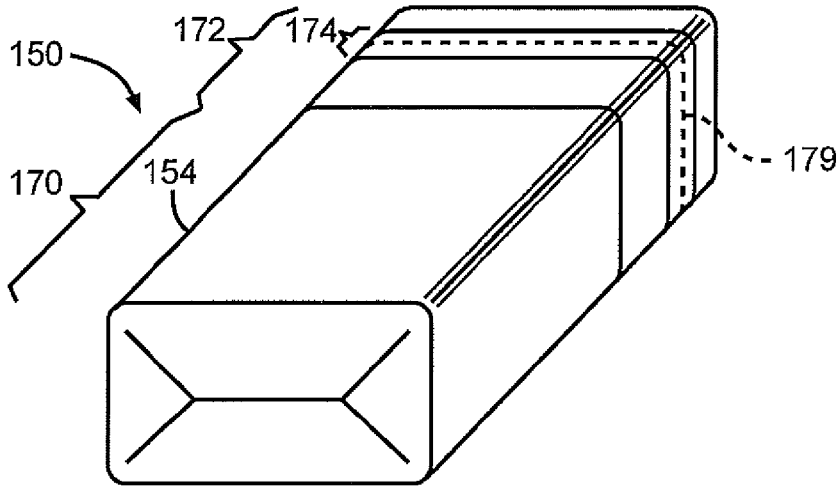
FIG. 6 is a perspective view of a second embodiment of a package of blowing wool.
Figure 7:
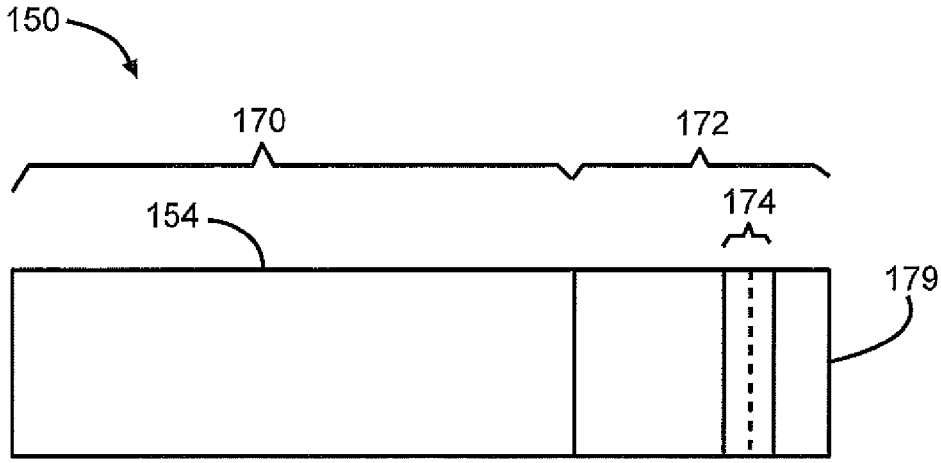
FIG. 7 is a side view in elevation of the package of compressed blowing wool of FIG. 6.

Referring now to FIGS. 6 and 7, a second embodiment of a package 150 is illustrated. The package 150 includes a first section 170, a second section 172 and a third section 174. In this embodiment, the first, second and third sections, 170, 172 and 174 are the same as or similar to first, second and third sections, 70, 72 and 74 illustrated in FIGS. 4 and 5 with the exception that the third section 174 is positioned within the borders of the second section 172. In the same manner as discussed above, the distinct visual characteristics of the third section 174, having the substantially red transparent background, positioned within the transparent background of the second section 172, is configured to draw the attention of the machine user away from the first and second sections, 170 and 172, to a suggested cut line 179 positioned within the third section 174.

While the illustrated embodiment shows the third section 174 as being positioned in the second section 172, it should be appreciated that the third section 174 can be positioned within other sections of the bag 154 sufficient to focus the attention of the machine user to the suggested cut line 179.

Figure 8:
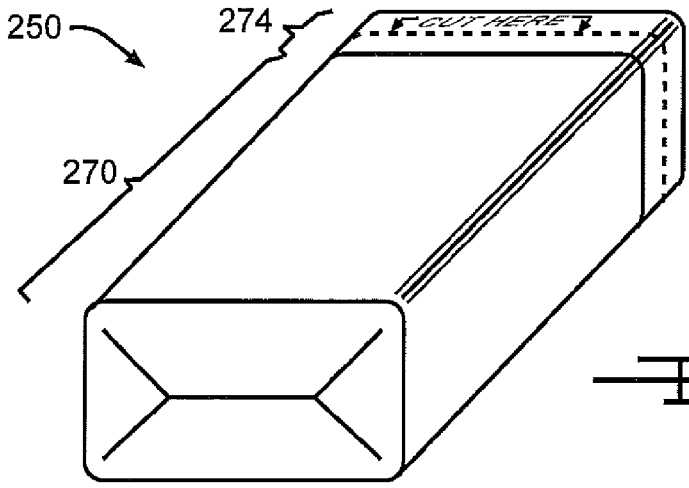
FIG. 8 is a perspective view of a third embodiment of a package of blowing wool.

Referring now to FIG. 8, a third embodiment of a package 250 is illustrated. The package 250 includes a first section 270 and a second section 274. In this embodiment, the first section 270 is the same as or similar to the first section 70 illustrated in FIGS. 4 and 5. The second section 274 is the same as or similar to the third section 74 illustrated in FIGS. 4 and 5. In the embodiment illustrated in FIG. 8, the package 250 has a quantity of two sections, 270 and 274, and both of the sections, 270 and 274 have a background color. In this embodiment, there is no transparent section having a lack of a background color.

Figure 9:
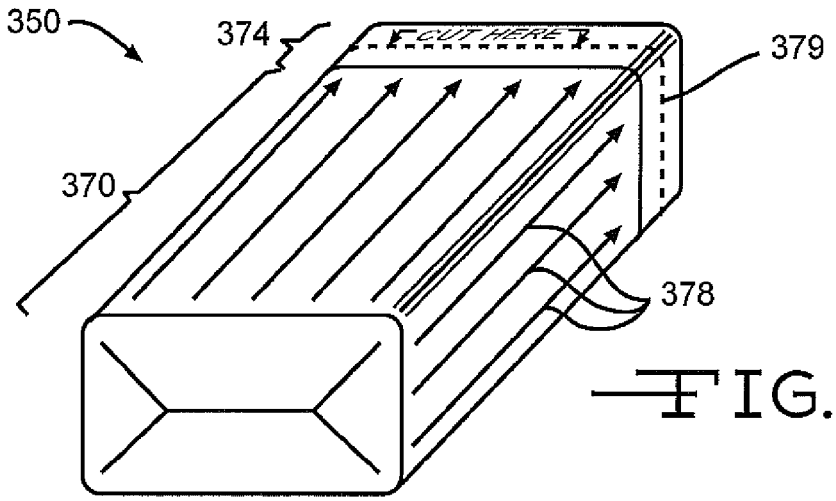
FIG. 9 is a perspective view of a fourth embodiment of a package of blowing wool.

Referring now to FIG. 9, a fourth embodiment of a package 350 is illustrated. The package 350 includes a first section 370 and a second section 374. In this embodiment, the first second 370 is the same as or similar to the first section 70 illustrated in FIGS. 4 and 5 with the exception that the first section 370 includes indicia 378 having the form of arrows. The arrows are configured to focus the attention of the machine user to the suggested cut line 379 positioned in the second section 374. The second section 374 is the same as or similar to the third section 74 illustrated in FIGS. 4 and 5. While the embodiment shown in FIG. 9 illustrates arrows extending substantially the length of the first section 370, it should be appreciated that other desired configurations of arrows, such as for example multiple rows of short arrows, can be used.

Figure 10:
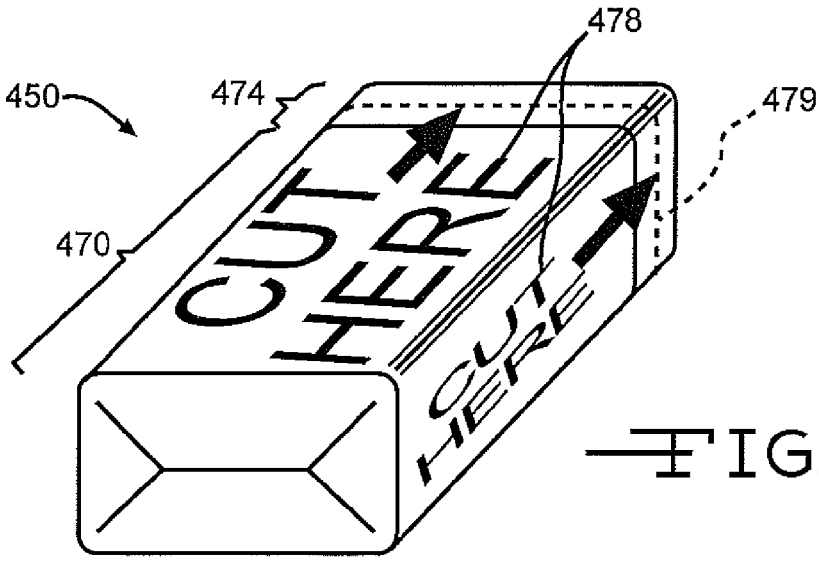
FIG. 10 is a perspective view of a fifth embodiment of a package of blowing wool.

Referring now to FIG. 10, a fifth embodiment of a package 450 is illustrated. The package 450 includes a first section 470 and a second section 474. In this embodiment, the first second 470 is the same as or similar to the first section 70 illustrated in FIGS. 4 and 5 with the exception that the first section 470 includes indicia 478 in the form of a combination of arrows and words. The arrows and words are configured to focus the attention of the machine user to the suggested cut line 479 positioned in the second section 474. The second section 474 is the same as or similar to the third section 74 illustrated in FIGS. 4 and 5. While the embodiment shown in FIG. 10 illustrates a combination of arrows and words extending substantially the length of the first section 470, it should be appreciated that other desired configurations of arrows and words can be used.

Figure 11:
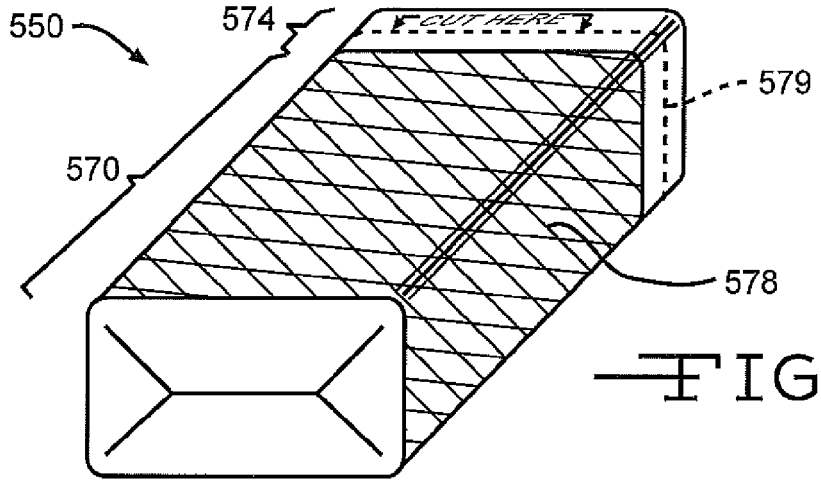
FIG. 11 is a perspective view of a sixth embodiment of a package of blowing wool.

Referring now to FIG. 11, a sixth embodiment of a package 550 is illustrated. The package 550 includes a first section 570 and a second section 574. In this embodiment, the first section 570 is the same as or similar to the first section 70 illustrated in FIGS. 4 and 5 with the exception that the first section 570 includes indicia 578 in the form of a pattern. The pattern is configured to focus the attention of the machine user to the suggested cut line 579 positioned in the second section 574. The second section 574 is the same as or similar to the third section 74 illustrated in FIGS. 4 and 5. While the embodiment shown in FIG. 11 illustrates a pattern having a cross-hatched design, it should be appreciated that other desired patterns, such as for example a checkerboard pattern, can be used.

Figure 12:
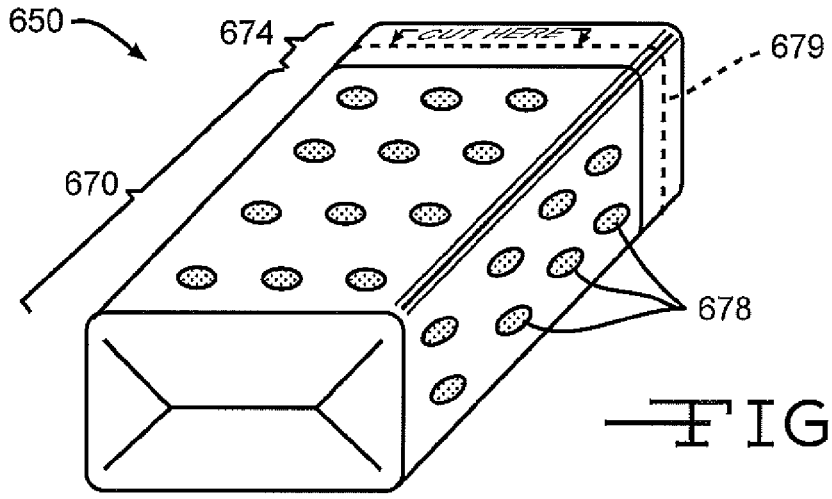
FIG. 12 is a perspective view of a seventh embodiment of a package of blowing wool.

Referring now to FIG. 12, a seventh embodiment of a package 650 is illustrated. The package 650 includes a first section 670 and a second section 674. In this embodiment, the first section 670 is the same as or similar to the first section 70 illustrated in FIGS. 4 and 5 with the exception that the first section 670 includes indicia 678 in the form of a plurality of spots. The plurality of spots is configured to focus the attention of the machine user to the suggested cut line 679 positioned in the second section 674. The second section 674 is the same as or similar to the third section 74 illustrated in FIGS. 4 and 5. While the embodiment shown in FIG. 11 illustrates a plurality of spots arranged in rows and columns, it should be appreciated that the plurality of spots can be arranged in other patterns or in a random orientation.

Figure 13:
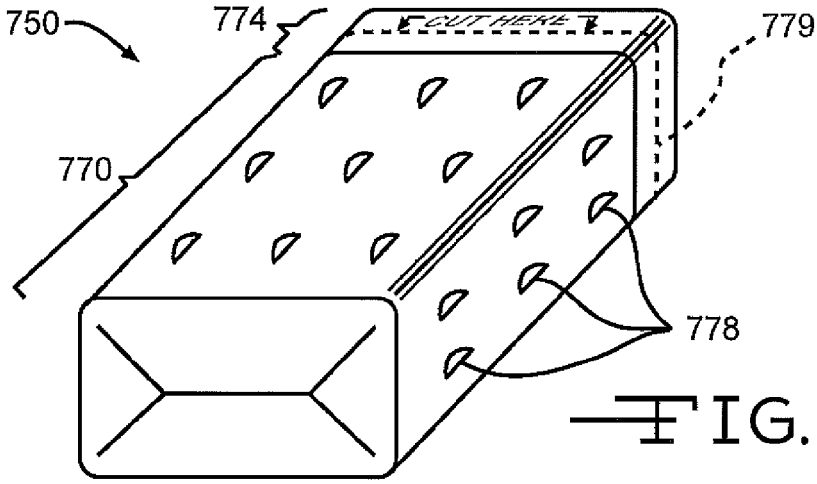
FIG. 13 is a perspective view of an eighth embodiment of a package of blowing wool.

Referring now to FIG. 13, an eighth embodiment of a package 750 is illustrated. The package 750 includes a first section 770 and a second section 774. In this embodiment, the first section 770 is the same as or similar to the first section 70 illustrated in FIGS. 4 and 5 with the exception that the first section 770 includes a plurality of textured structures 778. The plurality of textured structures 778 is configured to focus the attention of the machine user to the suggested cut line 779 positioned in the second section 774. The second section 774 is the same as or similar to the third section 74 illustrated in FIGS. 4 and 5. While the embodiment shown in FIG. 13 illustrates a plurality of textured structures 778 arranged in rows and columns, it should be appreciated that the plurality of textured structures 778 can be arranged in other patterns or in a random orientation. The textured structures 778 can be any desired shape, size, quantity or form.

Figure 14:
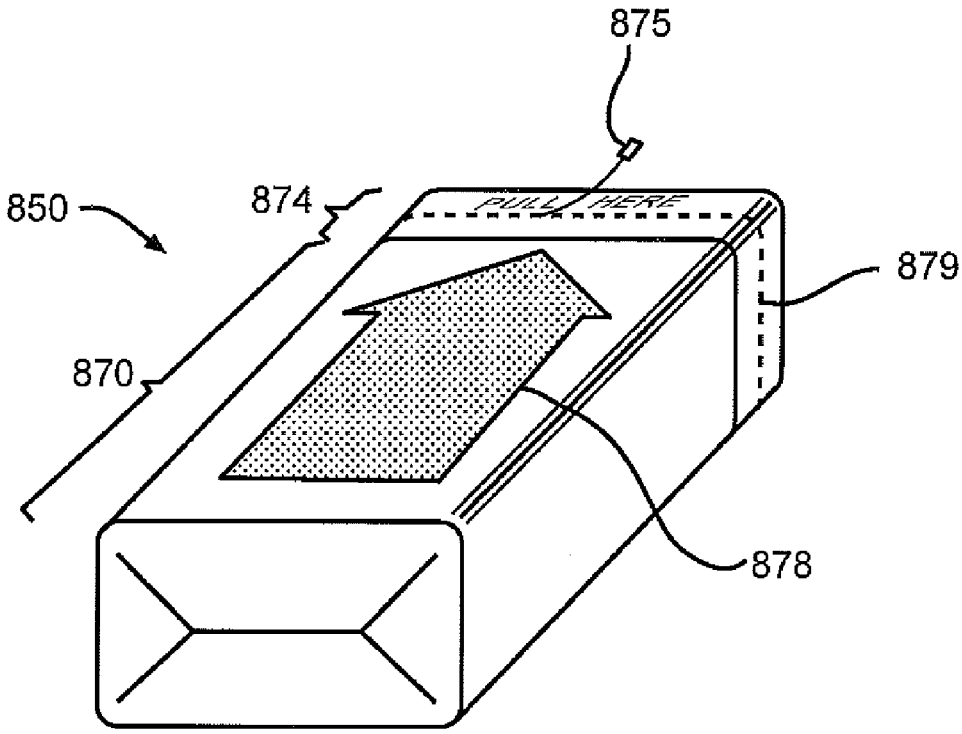
FIG. 14 is a perspective view of a ninth embodiment of a package of blowing wool.

Referring now to FIG. 14, a ninth embodiment of a package 850 is illustrated. The package 850 includes a first section 870 and a second section 874. In this embodiment, the first section 870 is the same as or similar to the first section 70 illustrated in FIGS. 4 and 5 with the exception that the first section 870 includes indicia 878 in the form of a large arrow and the suggested cut line 879, positioned in the second section 874, is configured with a tear-away mechanism 875. The arrow is configured to focus the attention of the machine user to the tear-away mechanism 875 positioned on the suggested cut line 879. The second section 874 is the same as or similar to the third section 74 illustrated in FIGS. 4 and 5. While the embodiment shown in FIG. 11 illustrates the tear-away mechanism 875 as a ripcord, as discussed above, it should be appreciated that the tear-away mechanism can be other desired mechanisms.

The principle and mode of operation of this blowing wool machine have been described in its preferred embodiments. However, it should be noted that the blowing wool machine may be practiced otherwise than as specifically illustrated and described without departing from its scope.

What is claimed is:

1. A package of compressed blowing wool comprising:

a body of compressed blowing wool, wherein the compression of the blowing wool is in a radially inward direction with respect to an axis extending from one end of the body of compressed blowing wool to another end of the body of compressed blowing wool; and a bag encapsulating the body of compressed blowing wool, the bag having a plurality of bag sections and opposing ends, the bag sections having contrasting visual characteristics configured to focus the attention of a user toward one end of the bag;

wherein one of the bag sections includes indicia configured to assist in opening one end of the bag.

2. The package of claim 1 wherein the bag has three sections.

3. The package of claim 1 wherein the bag has a width, a depth and a height, and wherein the width is approximately 19 inches, the depth is approximately 19 inches and the height is approximately 9 inches.

4. The package of claim 1 wherein the contrasting visual characteristics include different background colors or a lack of a background color.

5. The package of claim 4 wherein one of the background colors is red.

6. The package of claim 1 wherein the contrasting visual characteristics include transparency or opacity of the bag.

7. The package of claim 1 wherein the contrasting visual characteristics extend circumferentially around the bag.

8. The package of claim 1 wherein the indicia includes a suggested cut line.

9. The package of claim 1 wherein one of the sections is positioned within another section.

10. The package of claim 1 wherein one of the sections includes indicia having instructions for disposal of the bag.

11. The package of claim 1 wherein the compression of the body of blowing wool is retained in a radially inward direction after one end of the bag is opened.

12. A method of distributing blowing wool from a package of compressed blowing wool, the method comprising:

providing a package of compressed blowing wool, the package having a body of compressed blowing wool, the compression of the body of blowing wool being in a radially inward direction with respect to an axis extending from one end of the body of compressed blowing wool to another end of the body of compressed blowing wool and a bag encapsulating the body of compressed blowing wool, the bag having a plurality of bag sections and opposing ends, the bag sections having contrasting visual characteristics configured to focus the attention of a user toward one end of the bag, wherein one of the bag sections includes indicia configured to assist in opening one end of the bag;

opening one end of the bag thereby forming a package with an open end and a closed end, the bag being opened such that the compression of the body of blowing wool is retained in a radially inward direction after one end of the bag is opened;

gripping the closed end of the package;

feeding the open end of the package into a machine for shredding and picking apart the blowing wool, thereby emptying the bag; and withdrawing the empty bag from the machine.

13. The method of claim 12 wherein the bag has three sections.

14. The method of claim 12 wherein the bag has a width, a depth and a height, and wherein the width is approximately 19 inches, the depth is approximately 19 inches and the height is approximately 9 inches.

15. The method of claim 12 wherein the contrasting visual characteristics include different background colors or a lack of background color.

16. The method of claim 12 wherein the contrasting visual characteristics include transparency or opacity of the bag.

17. The method of claim 12 wherein the contrasting visual characteristics extend circumferentially around the bag.

18. The method of claim 12 wherein the indicia includes a suggested cut line.

19. The method of claim 12 wherein one of the sections is positioned within another section.

20. The package of claim 12 wherein the compression of the body of blowing wool is retained in a radially inward direction after one end of the bag is opened.

* * * * *